US005967160A

United States Patent [19]

Rochette et al.

[11] Patent Number: 5,967,160

[45] Date of Patent: Oct. 19, 1999

[54] AUTOMATIC DOOR AND FLOOR TILTING SYSTEM FOR A WASHER

[75] Inventors: Daniel Rochette, Charlesbourg; Michel Lemay, Ste-Foy; Yves-André Theriault, Beauport; Michel Emond, Lévis; Mario Duchaine, Beauport; Ghislain Parent, Cte-Lévis; Nathalie Thibault, Boischatel, all of Canada

[73] Assignee: Steris Corporation, Mentor, Ohio

[21] Appl. No.: 08/970,978

[22] Filed: Nov. 14, 1997

[51] Int. Cl.[6] ..... B08B 3/00

[52] U.S. Cl. ..... 134/200; 134/113; 160/118; 160/196.1; 49/141

[58] Field of Search ..... 52/64; 160/118, 160/196.1; 49/141; 134/200, 201, 123, 113, 133, 57 R

[56] References Cited

U.S. PATENT DOCUMENTS

| | | | |
|---|---|---|---|
| 3,354,581 | 11/1967 | Dimmitt et al. | 49/141 |
| 3,466,805 | 9/1969 | Muessel | 49/141 |
| 3,517,675 | 6/1970 | Sadwith | 134/144 |
| 3,698,029 | 10/1972 | Pulliam | 15/21 D |
| 4,063,388 | 12/1977 | Little | 49/363 |
| 4,290,368 | 9/1981 | Mazzini | 105/341 |
| 4,421,132 | 12/1983 | Kuhl | 134/123 |
| 4,777,675 | 10/1988 | Letner | 4/599 |
| 4,850,380 | 7/1989 | Koslow | 134/56 R |
| 4,858,256 | 8/1989 | Shankman | 4/597 |
| 4,882,876 | 11/1989 | Daugirdas | 49/141 |
| 4,922,559 | 5/1990 | Wall | 4/662 |
| 4,922,806 | 5/1990 | Newman et al. | 98/1.5 |
| 5,064,457 | 11/1991 | Weber | 55/385.2 |
| 5,074,897 | 12/1991 | Sikich | 55/385.2 |
| 5,133,375 | 7/1992 | Schinzing et al. | 134/123 |
| 5,365,993 | 11/1994 | Jella | 160/201 |
| 5,369,912 | 12/1994 | Ginzel et al. | 49/141 |
| 5,524,395 | 6/1996 | Boiron | 52/64 |
| 5,551,102 | 9/1996 | Stewart et al. | 4/612 |
| 5,607,652 | 3/1997 | Hellmuth et al. | 422/300 |
| 5,709,259 | 1/1998 | Lewis et al. | 160/201 |

FOREIGN PATENT DOCUMENTS

| | | | |
|---|---|---|---|
| 0163942 | 5/1985 | European Pat. Off. | E06B 3/50 |

*Primary Examiner*—Jill Warden
*Assistant Examiner*—Paul J. Lee
*Attorney, Agent, or Firm*—Fay, Sharpe, Beall, Fagan, Minnich & McKee, LLP

[57] ABSTRACT

Retractable doors 22 to a washing chamber 20 of a washer 10 open automatically to allow a load to be processed to be wheeled into the chamber. The doors are fitted with blowout panels 42, 44. In an emergency, a worker trapped in the washing chamber can escape by pushing the blowout panels outward. A tilting floor assembly 70 includes a floor 76 supported on a frame 74 and a lifting mechanism 90 for selectively raising and lowering a side of the frame to tilt the floor. The floor is tilted automatically during a cleaning cycle to allow cleaning fluids to drain from the load, then leveled before opening of the doors for ease of removal of the load.

24 Claims, 5 Drawing Sheets

AUTOMATIC DOOR AND FLOOR TILTING SYSTEM FOR A WASHER

BACKGROUND OF THE INVENTION

The present invention relates to the cleaning and disinfecting arts. It finds particular application in conjunction with the safe and expedient cleaning of animal cages and racks and pieces of healthcare and scientific equipment, such as hospital beds, wheelchairs, utensils, carts and instrument containers, and will be described with particular reference thereto. It should be appreciated, however, that the invention is also applicable to the cleaning of other large pieces of equipment, that are manually wheeled into housings that are hazardous to the operator in the event the operator is trapped inside.

Items such as animal cages and associated racks and large pieces of scientific and healthcare equipment are generally cleaned at frequent intervals to remove biological waste, such as urine, feces, and uneaten food. Thorough cleaning aids in preventing the spread of disease and reduces the development of unpleasant odors. Washers have been developed to handle the large scale cleaning and disinfecting of such items. Typically, the washers are large enough for a load to be processed to be wheeled manually into a washing chamber through a refrigerator-type door. The floor of the washing chamber is usually sloped to allow cleaning fluids, sprayed onto the load, to run off the load. The used fluid is collected in a pit or sump, below the washer.

When large numbers of items are to be cleaned, ease of loading and unloading is an important factor. Also, the typical washer is large and the space occupied by the washing chamber and washer door is of concern. In a typical washer, the washer door is manually operated and swings outward on hinges. The operator allows for the outward swing by parking the cage cart, temporarily, at a distance from the washer greater than the outward swing, before manually opening the door. After wheeling the load into the washer, the doors are locked and cleaning of the load commences. Another type of washer door folds inward as it opens, in concertina fashion. This allows the load to be rolled right up to the washer doors before opening them. However, the doors take up space within the washer when open, reducing the space available in the washing chamber for the load of to be processed. The chemicals and temperatures employed in such washers create an environment which is hazardous to operators that are accidentally trapped in the washing chamber during a wash cycle. Operators are sometimes called to work in the washing chamber between cycles such as for making repairs and for cleaning components of the washing chamber. In the event that the door is closed during this period and a washing cycle accidentally commenced, the operator has a fairly short period of time to exit the washing chamber before risking serious injury. Frequently, washers employ safety devices such as safety cables and latch mechanisms which allow the operator to open the doors from the inside. These safety devices are not always immediately accessible to the operator, particularly when the washing chamber is loaded with items to be processed. Further, visibility is often reduced during a cycle due to limited illumination of the chamber and the vapor generated by the incoming cleaning fluid. In combination with the panic often experienced by the operator, these factors sometimes inhibit the ability of the operator to exit the washing chamber quickly.

There remains a need for a door mechanism for a washing chamber which allows for ease of loading items to be processed into the washer and which permits rapid egress for an operator trapped in the chamber.

Cages and racks and other scientific and healthcare equipment often have flat, solid panels which tend to collect water. Puddled water impedes the wash water from striking the covered panel with full velocity and inhibits cleaning and rinsing. A number of systems have developed for tilting a moveable floor of the washing chamber to angle the load so that cleaning fluid runs off the normally horizontal parts of the load. In one tilting system, cables are connected to four corners of the floor. Four separate air cylinders are used to draw the cables selected distances for tilting the floor. Because of the cost and complexity of such systems for moving the floor, the floor is often permanently mounted in the tilted position. Between cycles, loading and unloading of the load is more difficult and a strain is put on the load and transfer carts. Further, in the event of a failure of the air supply for the air cylinders, the floor is not held in position. The sudden leveling of the floor poses a hazard to operators working inside the washing chamber.

A sump beneath the washing chamber collects the cleaning fluid as it drips from the load. To allow the cleaning fluid to pass easily into the sump, the floor generally comprises a series of spaced rails. In one type of washer, the floor of the washing chamber comprises two traveling rails, situated a spaced distance apart. The distance between the rails is adjustable to allow for different widths of loading trolleys to be wheeled into the washing chamber on the two rails. The space between the rails provides a direct access to the sump. The hot cleaning fluid which collects in the sump therefore poses a hazard to operators inside the washing chamber.

There remains a need for a tilting floor for the washing chamber of a washer that automatically levels the floor between cycles for ease of loading an unloading and that allows operators to work in safety within the washing chamber.

SUMMARY OF THE INVENTION

In accordance with one aspect of the present invention, a washer is provided. The washer includes a washing chamber with an opening for providing access to the washing chamber. Retractable doors selectively seal the opening and open to allow a load to be processed to be wheeled into the washing chamber. The doors include a plurality of blowout panels and a blowout mechanism which releasably couples at least one of the panels to the doors such that when pushed outward from the interior of the washing chamber, the panel opens out, allowing escape from the chamber interior.

In accordance with another aspect of the invention, a washer is provided. The washer includes a washing chamber having an access opening to provide access to the washing chamber and tracks disposed within the washing chamber which extend along the access opening and curve to run along side walls of the chamber. Automatic doors selectively seal the access opening, the tracks guiding the washer doors as they are retracted into the chamber. The doors include a plurality of panels and hinges which allow the doors to pivot around a vertical axis between the panels to facilitate movement of the doors along the curving tracks.

in accordance with yet another aspect of the invention, a washer includes a washing chamber and a tilting floor assembly. The assembly includes a frame support, a frame supported by the frame support, a floor supported by the frame, and a lifting mechanism for selectively raising and lowering a side of the frame. The lifting mechanism includes rotating cams which lift the side of frame a selected distance when rotated an a tilt drive mechanism which rotates the cams to raise and lower the frame side the selected distance to tilt the floor.

In accordance with another aspect of the invention, a method for sealing a washing chamber of a washer, and providing an emergency exit from the chamber is provided. The method includes releasably coupling two blowout panels together to form a door and inserting the door into tracks disposed in the washing chamber, the tracks extending around an opening in the chamber for selectively guiding the door into and out of the chamber, thereby sealing and unsealing the opening. The method further includes sealing the opening with the door and pressing on an interior surface of one of the panels thereby uncoupling the blowout panels so that they open outward to provide an emergency exit from the chamber.

In accordance with another aspect of the invention, a method for introducing and removing a load of to be processed into a washing chamber of a washer is provided. The method comprises retracting retractable doors into the washing chamber and wheeling the load through an opening in the washing chamber and into the washing chamber. The method further comprises closing the retractable doors across the opening to seal the washing chamber and spraying a cleaning fluid over the load. The method also comprises retracting the doors into the washing chamber, so as to avoid droplets of the cleaning fluid from dripping from the doors outside the washer and wheeling the load from the chamber and through the opening.

In accordance with yet another aspect of the present invention, a method for introducing and removing a cart supporting a load to be cleaned into a washing chamber of a washer is provided. The method comprises retracting retractable doors into the washing chamber and wheeling the cart through an opening in the washing chamber and onto a tiltable floor disposed in the washing chamber. The method further comprises closing the retractable doors across the opening to seal the washing chamber and raising a side of the tiltable floor, thereby tilting the load. After completion of a washing cycle, the method includes lowering the side of the tiltable floor, thereby leveling the load and then retracting the doors into the washing chamber and wheeling the load from the chamber.

One advantage of the present invention is that it enables operators working inside the washing chamber to exit the chamber rapidly, in the event of a cycle commencing.

Another advantage of the present invention resides in simplicity of wheeling of a load to be processed into the chamber.

Further advantages of the present invention reside in the retraction of the washer doors into a compact space within the washing chamber which reduces the space occupied by the washer and also limits the amount of cleaning fluid that drips outside the washing chamber when the doors are open.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
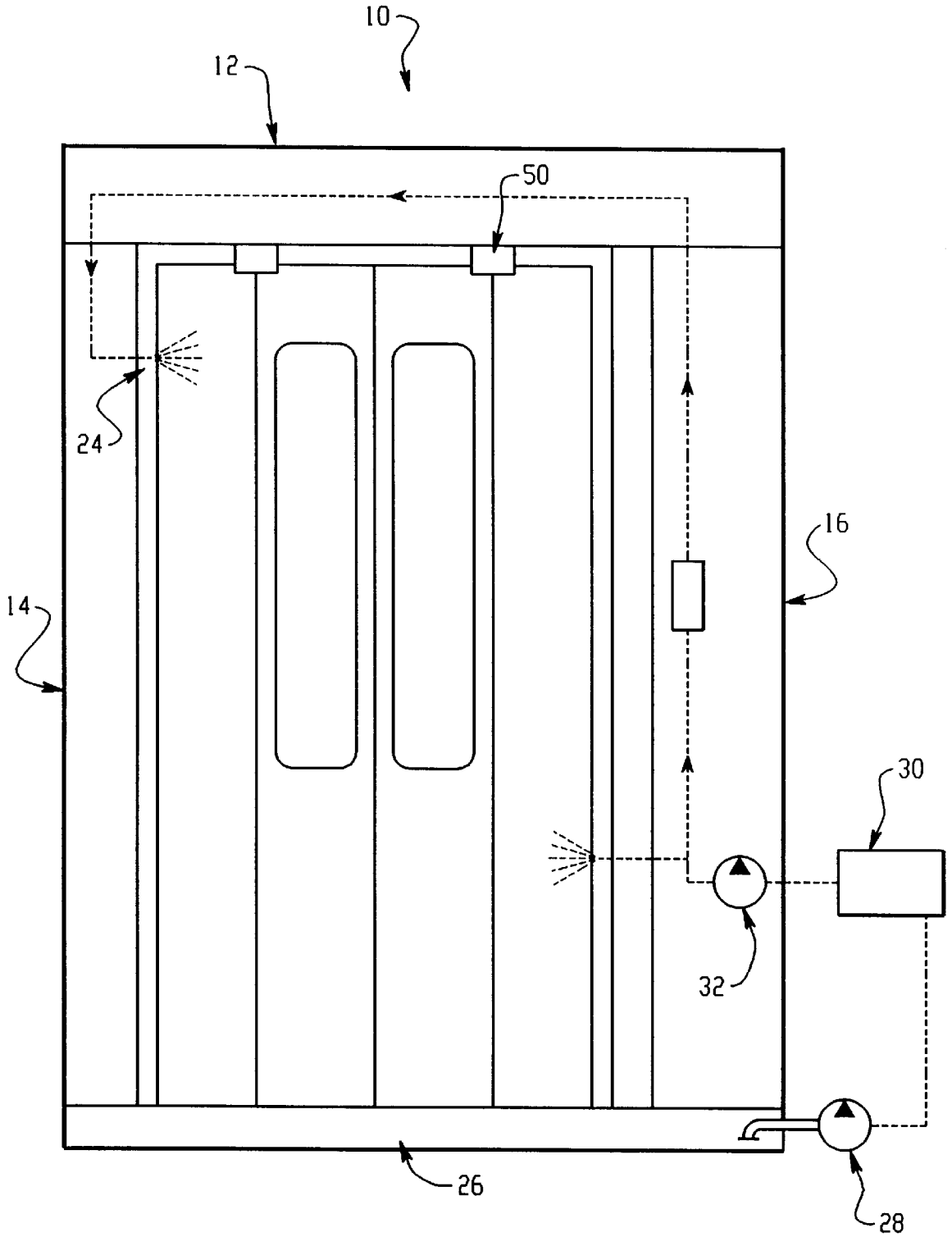
FIG. 1 is a diagrammatic view of a preferred embodiment of a washer with blowout doors according to the present invention.
Figure 2:
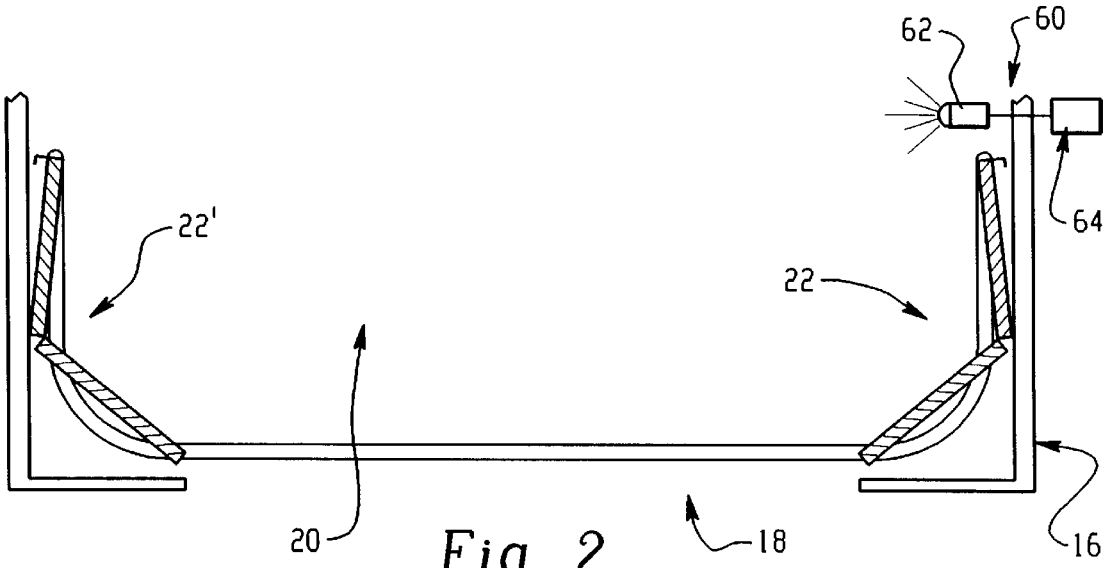
FIG. 2 illustrates an top view of the blowout doors of FIG. 1.

With reference to FIGS. 1 and 2, a load to be cleaned is wheeled into a washer 10. The washer includes a top 12 and sides 14 and 16. An opening 18 provides access to an interior washing chamber 20. Two double panel retractable doors 22, 22' are closed, sealing the opening into the washing chamber.

Spray nozzles 24, in the interior washing chamber 20, spray a cleaning fluid over the load in the chamber. A sump 26, located beneath the washing chamber 20, collects the used fluid as it drips down from the washing chamber. A sump pump 28, pumps the used fluid from the sump to a tank 30 for recycling or to a drain (not shown) for disposal. Optionally, a sump heating coil (not shown) heats the fluid in the sump to maintain the temperature of the fluid for reuse. A higher pressure pump 32 pumps the recirculated fluid from the tank 30 to the nozzles 24.

After cleaning of the load is complete, the doors 22, 22' are opened and the load is wheeled from the chamber 20. Preferably, the washing chamber includes a second opening and a second set of doors (not shown) at the opposite end, for wheeling the clean load from the chamber. For ease of discussion, however, the front set of doors will be described in detail and it will be understood that it applies also to the rear set of doors.

Figure 3:
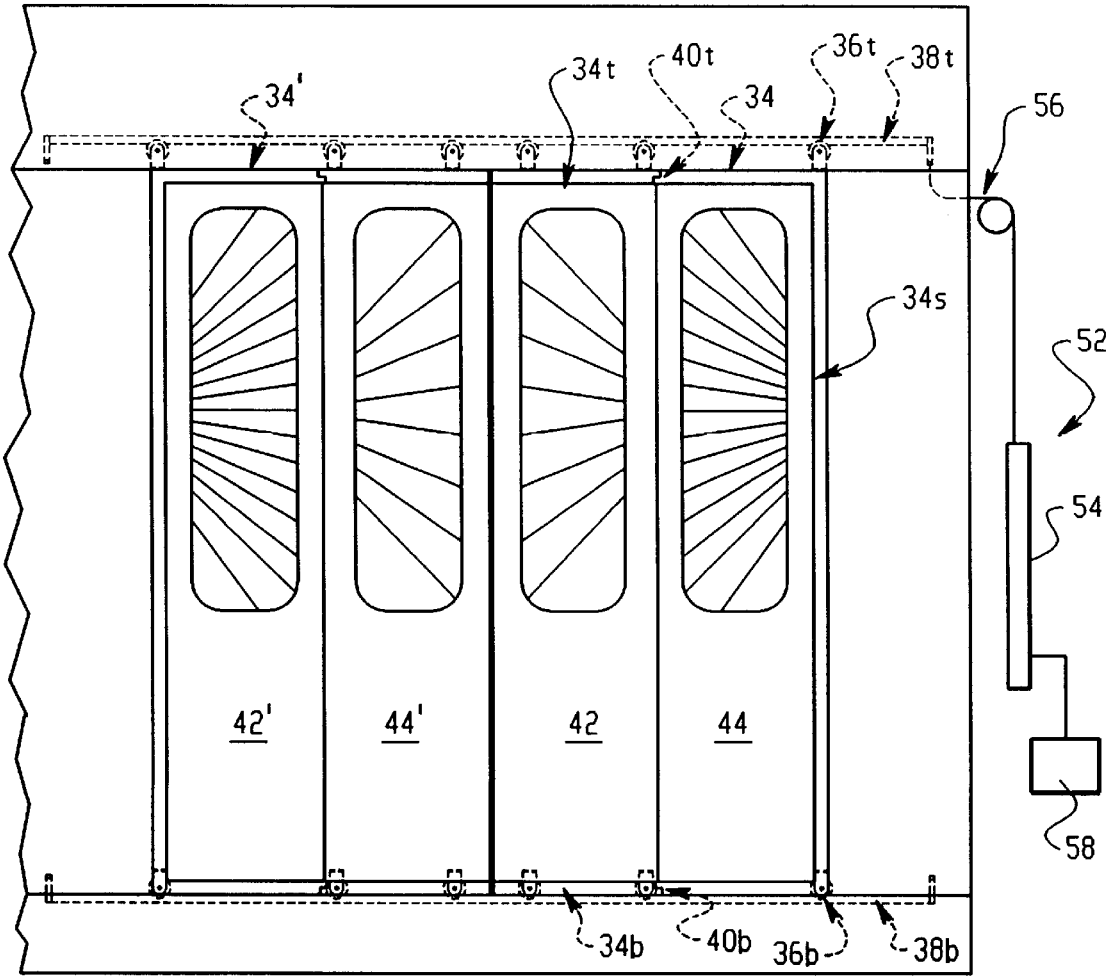
FIG. 3 is front elevational view of the washer of FIG. 1.

With continued reference to FIGS. 1 and 2 and reference also to FIG. 3, the washing chamber doors 22, 22' include peripheral frames 34, 34', respectively. The peripheral frames include a top section **34*t* a bottom section 34*b* and at least one side section 34*s***.

The top frame sections **34*t* are connected with rollers 36*t* which slidingly engage a guide track or a top guide track 38*t*. Similarly, the bottom frame members are connected with rollers 36*b* which ride in a lower guide track 38*b*. As illustrated most clearly in FIG. 2, the top and bottom guide tracks extend linearly along the front of the washer, bend 90°, and extend a short distance along the sidewalls of the washing chamber 20. In order to facilitate opening and closing of the doors 22, 22', the top and bottom frame members include hinges 40*t*, 40*b*, respectively. This enables the door panel 22 to pivot midway (Note FIG. 2**) as the doors move around the curve in the tracks.

Figure 4:
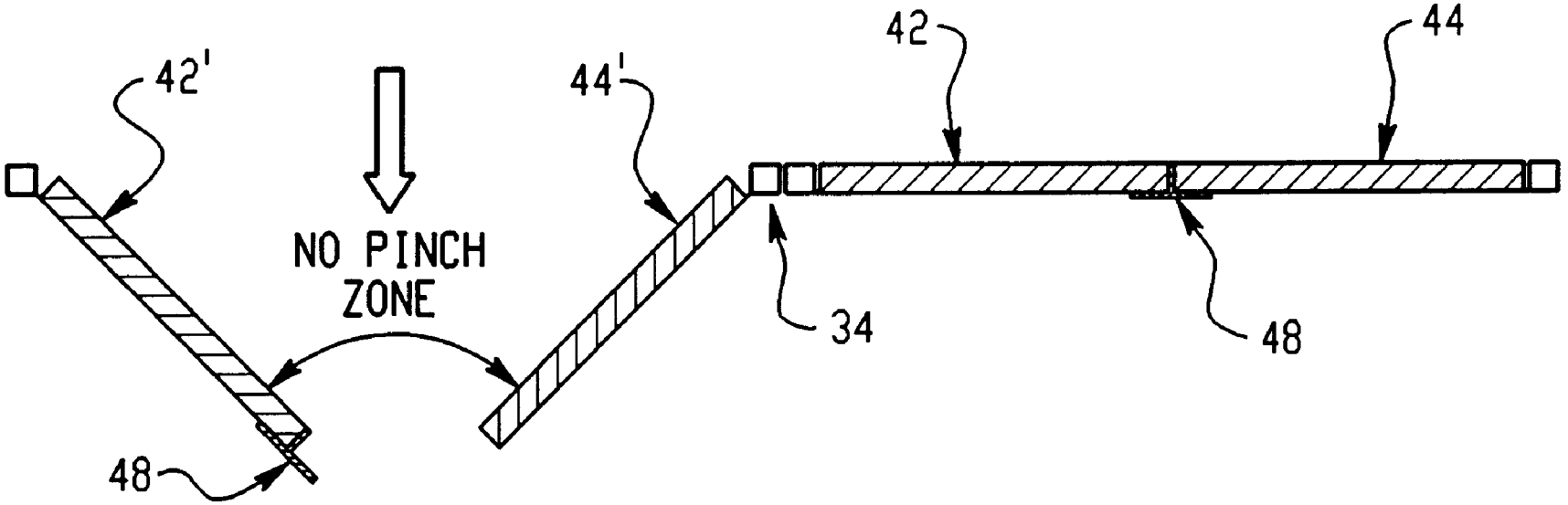
FIG. 4 is top view of the doors of FIG. 3 after an emergency opening.

Each of the two door sections 22, 22' include a pair of panels 42, 44 and 42', 44', respectively. Looking in detail to the door panel 22, with it being understood that the explanation applies equally to door 22', the door panels 42, 44 are pivotally connected with the frame 34. More specifically to the illustrated embodiment, door panel 44 is pivotally connected to the side frame member **34*s*. If a center frame member is provided along the butting edges of the doors, panel 42 is pivotally connected to the center frame member. In the illustrated embodiment in which there is no center frame member, the panel 42 is pivotally connected by vertical pivot pins to the top and bottom frame sections 34***t*, 34*b*. As best illustrated in FIG. 4, the hinges are arranged such that the panels 42, 44 pivot outward relative to the frame 34. In this manner, an operator trapped in the machine can strike the door panels 42, 44 causing them to blow open allowing a ready escape.

The edges of panels 42, 44 align with the frame hinges 40*t*, 40*b* to provide a pivot point for the entirety of door 22.

Of course, the panels 42, 44 are not opened in normal operation, hence should not open so easily that they open inadvertently. Moreover, door panels 42, 44 abut the frame 34, and each other, with a water-tight seal to prevent fluid leakage. Appropriate weather stripping is provided along the top, bottom, and hinge side interfaces between the panels and the frame. Between panels 42, 44, a T-shaped gasket 48 of silicone rubber is fitted. More specifically, an outer face of the T-shaped gasket provides a cosmetic cover for the gap between the panels. A central shaft of the T is frictionally engaged between the doors in a fluid tight seal. In the referred embodiment, the frictional engagement inhibits the doors from opening until a sufficiently high opening force is applied. The T-shaped gasket further provides a flexible bearing surface between the panels 40, 42 as the door moves around the 90° bend in the tracks 38. A break away control mechanism 50 is mounted adjacent the top intersection of the panels 42, 44. The mechanism 50 is mounted to the washer 10 such that the doors move in and out of contact with it as they open, although an analogous mechanism can be mounted to the top frame 34*t*. The mechanism 50 yields under a preselected force to allow the door panels to open in an emergency. Moreover, the mechanism 50 includes an electrical switch or sensor which senses one or more of the panels has been opened. When the switch or sensor senses the opening of one of the emergency panels, the pump 32 is disabled and the washing cycle automatically aborted. In this manner, when the emergency escape panels start to open, the supply of potentially dangerous fluids into the chamber is immediately terminated.

Preferably, a drive system 52 opens and closes the doors 22. Two equivalent drive systems are preferably used, one for each door, but for ease of discussion a single drive system 52 is described. The drive system includes a drive mechanism, such as first pneumatic cylinder 54, and one or more cables. The cable 56 continuous path around the upper and/or lower track 38*t*, 38*b*. The pneumatic cylinder draws the cables a fixed distance in one direction for retracting the door and an equivalent, fixed distance, in an opposite direction for closing the door. A control circuit 58, controls the operation of the pneumatic cylinder and allows the operator to open the doors by a touch of a switch. Preferably the pneumatic cylinder and control circuit are located outside the washing chamber 20 so that they are not harmed by the cleaning fluids and high temperatures employed in the chamber.

With particular reference to FIG. 2, as an additional safety feature, a warning system 60 warns operators within the washing chamber 20 when a cycle is about to commence. The warning system includes a light, such as fluorescent light 62, disposed within the washing chamber. The light brightly illuminates the interior 20 of the chamber to allow the operator to complete repairs and to provide operators outside the chamber with a clear view of the interior and the load. A warning light control circuit 64 switches the light off for a short period or periods a few seconds before the washing cycle is about to commence. This gives the operator sufficient warning of the start of the cycle to enable the operator to exit the washing chamber before cleaning fluid is sprayed from the nozzles 24. Although the warning system has been described with reference to a light, other warning systems are also envisaged such as a system incorporating an audio alarm which sounds a siren, for example, as the cycle is about to commence.

Figure 5:
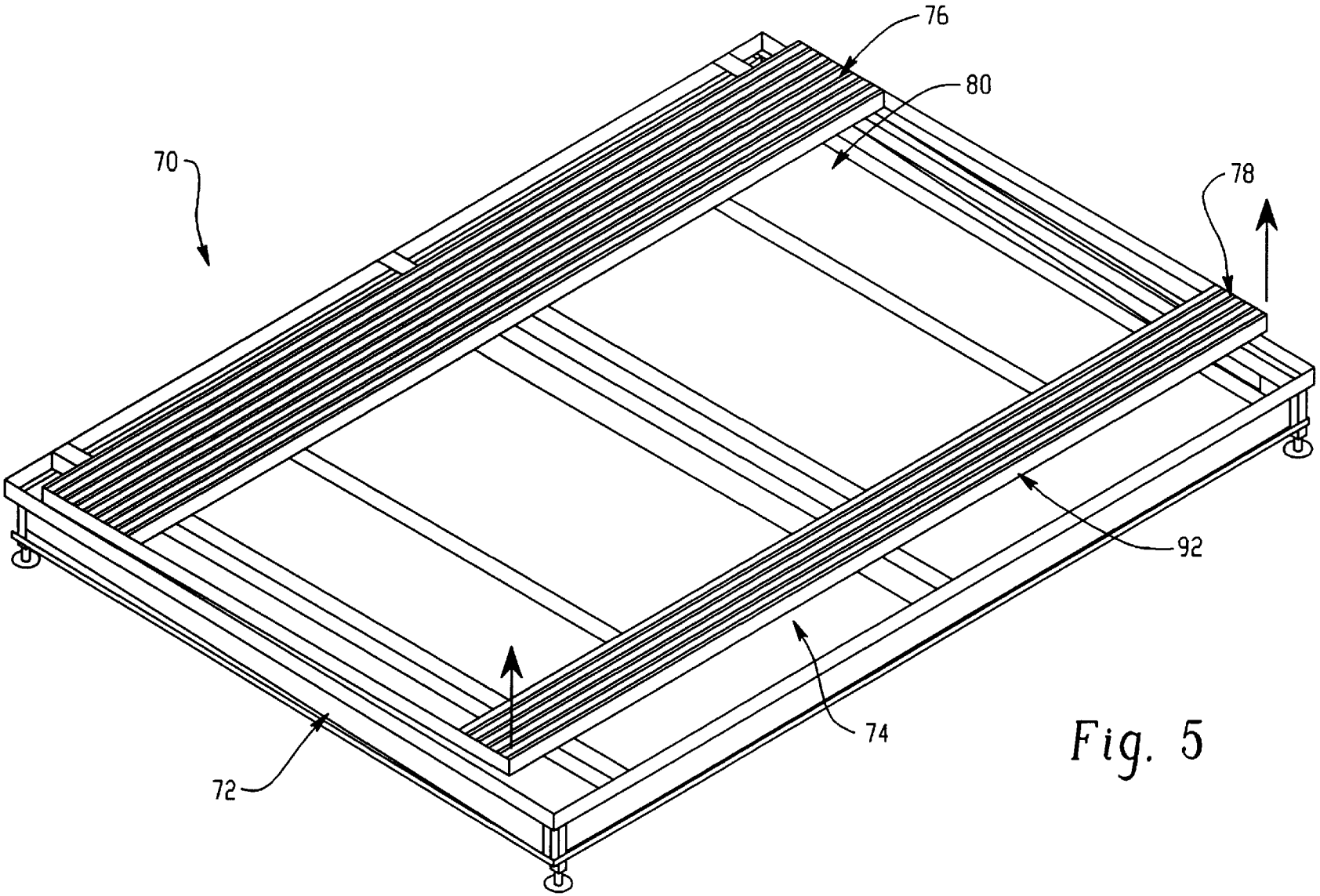
FIG. 5 is a perspective view of a tilting floor assembly for a washing chamber of a washer according to the present invention.

With reference now to FIG. 5, a tilting floor assembly 70 forms the base of the washing chamber 20. The floor includes a frame support 72 which rests in the sump, and a tiltable frame 74 supported by the frame support. A floor, preferably comprising floor panels 76 slots into the tiltable frame 74. The floor panels are removable for access to the sump 26 beneath. The floor panels include ridges 78, the ridges running parallel to the sides 14, 16 of the washing chamber. This arrangement of ridges running from the entrance doors to the exit doors allows the loads to be wheeled easily into the washing chamber and helps to prevent the load from sliding sideways when the floor is tilted. Gaps 80 are defined between the floor panel ridges to drain the used cleaning fluid into the sump. Preferably the gaps are about 3 cm wide, or less, so that the wheels of the carts are not caught in the gaps as the load is wheeled into the washing chamber.

Figure 6:
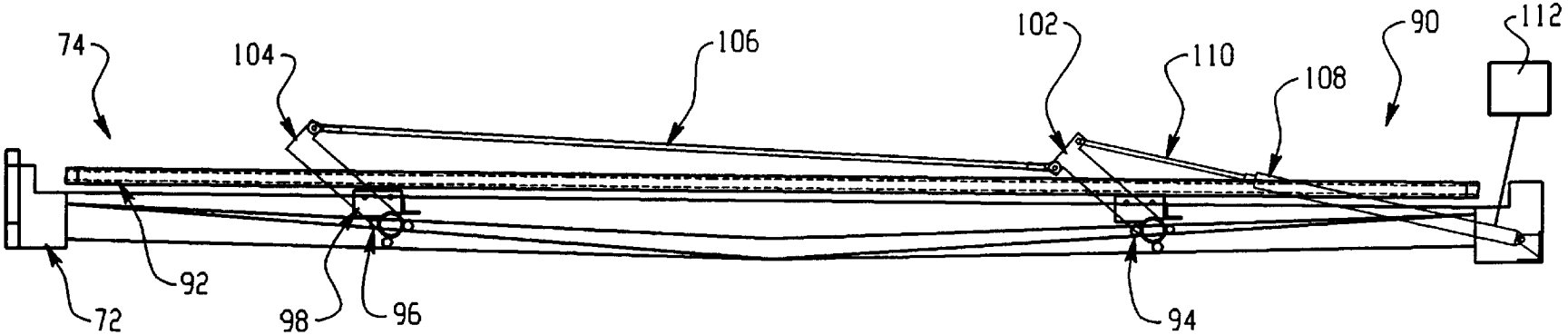
FIG. 6 is an end view of the tilting mechanism for the tilting floor assembly of FIG. 5.

With reference also to FIG. 6, a lifting mechanism 90 raises a side 92 of the frame 74 a selected distance to tilt the floor. This distance is chosen to provide optimal cleaning of the load and draining of the cleaning fluid therefrom, while at the same time avoiding shifting of the load during the cleaning cycle. A preferred tilt is around 2 cm/m.

The lifting mechanism includes first and second rotating cams 94 and 96, respectively, pivotally mounted to the frame support 72 beneath the frame 74. The cams engage cam followers 98 on a lower surface of the side 92 of the frame, lifting the side of the frame upward by a preselected amount as they rotate. This causes the frame to tilt. First and second levers 102 and 104 are connected to a common shaft with the first and second cams, respectively, to rotate with the cams. A bar 106 connects the first and second levers, respectively, such that the cams are constrained each rotate by the same amount. The lifting mechanism also includes a tilt drive mechanism, preferably a second pneumatic cylinder 108. The cylinder 108 includes a rod 110 which is connected to the first lever 102 at a spaced distance from the first cam 94. As the rod is drawn into the cylinder 108 the two connected levers 102, 104 are also pulled toward the cylinder, thereby rotating the cams and lifting the side of the frame. As a safety feature, the cams are shaped and configured to lock against clockwise rotation at or slightly past top dead center such that, in the event of a failure of the second pneumatic cylinder 108, the cams do not rotate and therefore do not allow the floor to fall from its tilted position.

When the cleaning cycle is complete, the frame 74 is lowered, leveling the floor to allow the cart to be wheeled easily from the washing chamber 20. The process of lowering the floor is the reverse of that described above for tilting the floor. Preferably, a tilt control circuit 112 recognizes the end of the cycle and directs the second pneumatic cylinder 108 to lower the frame. Lowering the frame automatically before the doors are opened allows for a simpler floor design because it reduces the possibility that the blowout panels will bump against the frame as they are retracted into the washing chamber.

The levers, rod and pneumatic cylinder are all disposed outside the washing chamber so that they are not subject to the cleaning cycle environment. The cams are preferably constructed of a material which withstands the strong chemicals often used in the cleaning fluids.

The invention has been described with reference to the referred embodiment. Obviously, modifications and alterations will occur to others upon reading and understanding the preceding detailed description. It is intended that the invention be construed as including all modifications and alterations insofar as they come within the scope of the appended claims or the equivalents thereof.

Having thus described the preferred embodiment, the invention is now claimed to be:

1. A walk-in washer for cleaning inanimate items in an environment which would be hazardous to a human operator trapped inside, the washer including:

a washing chamber;

an opening for providing access to the washing chamber;

a retractable door assembly which selectively seals the opening and opens to allow a load of the inanimate items to be processed to be wheeled into the washing chamber, the retractable door assembly being cumbersome to open from within the washing chamber, the door assembly including:

a plurality of doors, a plurality of vertical hinges which interconnect the doors and allow the doors to pivot around vertical axes during opening and closing, a plurality of blowout panels which are mounted in the doors and are positioned for ready access from an interior of the washing chamber while the retractable door assembly is closed, and a blowout mechanism which releasably decouples at least one of the panels from the doors in response to outward manual pressure such that when pushed outward from the interior of the washing chamber, the panel opens out, allowing the operator to escape from the chamber interior.

2. A washer comprising:

a washing chamber;

an opening for providing access to the washing chamber;

retractable doors which selectively seal the opening and open to allow a load to be processed to be wheeled into the washing chamber, each of the doors including:

a plurality of blowout panels, and a blowout mechanism including a gasket connected to a first of the blowout panels and engaging and compressed against a second of the blowout panels, the blowout mechanism releasably coupling at least one of the first and second panels to one of the retractable doors, a preselected pressure on an interior wall of one of the panels disengaging the compressed gasket, thereby allowing the panels to swing outward, away from an interior of the washing chamber, allowing an operator inadvertently trapped in the chamber interior to escape from the chamber interior, the panels remaining in an outward position until the blowout mechanism is reassembled.

3. The washer of claim 2, wherein the first and second blowout panels are configured for swinging outwardly in generally opposite directions.

4. The washer of claim 2, further including an electrical switch or sensor which stops a washing cycle on detecting an opening of one of the panels.

5. A walk-in washer for cleaning inanimate items in an environment which would be hazardous to a human operator trapped inside, the washer comprising:

a washing chamber;

an opening for providing access to the washing chamber;

retractable doors which selectively seal the opening and open to allow a load of the inanimate items to be processed to be wheeled into the washing chamber, the retractable doors being cumbersome to open from within the washing chamber, the doors including:

a plurality of blowout panels which open while the retractable doors are closed, and a blowout mechanism which releasably couples at least one of the panels to the doors in response to outward manual pressure such that when pushed outward from the interior of the washing chamber, the panel opens out, allowing the operator to escape from the chamber interior; and tracks disposed within the washing chamber extending along the access opening and curving to run along side walls of the chamber, the tracks guiding the washer doors as they are retracted into the chamber, the doors being hinged between the panels to facilitate movement along the curving tracks.

6. The washer of claim 5, the blowout mechanism further including:

a break-away control mechanism mounted to the washer which engages at least one of the blowout panels and resists outward movement of the blowout panel, and wherein a preselected pressure on an interior of the at least one of the first and second panels causes the mechanism to flex and release the panel.

7. The washer of claim 5, further including:

a drive system which selectively retracts the doors and closes the doors, the drive system including:

a cable which follows the track and is attached to the doors;

a drive mechanism connected to the cable for selectively drawing the cable a fixed distance in one direction to retract the doors and drawing the cable a fixed distance in an opposite direction to close the doors.

8. The washer of claim 7, wherein the drive mechanism includes a pneumatic cylinder.

9. The washer of claim 7 wherein the drive system further includes a control circuit for controlling the opening and closing of the doors.

10. A washer comprising:

a washing chamber;

an opening for providing access to the washing chamber;

retractable doors which selectively seal the opening and open to allow a load to be processed to be wheeled into the washing chamber, the doors including:

a plurality of blowout panels, and a blowout mechanism which releasably couples at least one of the panels to the doors such that when pushed outward from the interior of the washing chamber, the panel opens out, allowing escape from the chamber interior; and, a tilting floor assembly including a floor, the floor selectively tilting to encourage cleaning fluids used in the washing chamber to drain from the load and leveling to allow the load to be loaded and unloaded from the washing chamber.

11. The washer of claim 10 further including:

a tilt control circuit which recognizes that a cleaning cycle has ended and levels the tilting floor assembly before the doors are opened.

12. The washer of claim 10, wherein the tilting floor assembly includes:

a frame support;

a frame supported by the frame support;

a floor supported by the frame; and, a lifting mechanism for selectively raising and lowering a side of the frame, the lifting mechanism including:

rotating cams which lift the side of frame a selected distance when rotated, and a tilt drive mechanism which rotates the cams to raise and lower the frame side the selected distance to tilt the floor.

13. The washer of claim 12, wherein the lifting mechanism further includes:

levers, the levers connected to each of the cams, and a bar which connects the levers, the tilt drive mechanism connected to one of the levers.

14. The washer of claim 12, wherein the floor includes:

floor panels which slot into the frame, the panels having ridges which run perpendicular to an access opening in the washing chamber.

15. A washer of the type which sprays articles to be cleaned with a cleaning fluid which is dangerous to people, the washer comprising:

a washing chamber;

an access opening providing access to the washing chamber for loading and unloading the articles;

a floor for supporting the articles in the washing chamber the floor having openings to pass the spent cleaning fluid to the sump;

a sump at a bottom of the chamber into which spent cleaning fluids flow for recycling;

horizontally extending tracks disposed within the washing chamber which extend along the access opening and curve to run along side walls of the chamber;

automatic doors for selectively sealing the access opening, the tracks guiding the washer doors as they are retracted into the chamber such that cleaning fluids from a prior washing cycle drips off the open doors into the chamber, each of the doors including:

a plurality of panels, hinges which allow the doors to pivot around a vertical axis between the panels to facilitate movement of the doors along the curving tracks, and a seal between the panels which provides a fluid tight seal when the doors are in a closed position.

16. The washer of claim 15, further including a blowout mechanism which releasably couples at least one of the plurality of panels to the doors such that when pushed from the interior of the washing chamber, the at least one panel opens out, allowing escape from the chamber interior.

17. A washer comprising:

a washing chamber;

an access opening providing access to the washing chamber;

tracks disposed within the washing chamber which extend along the access opening and curve to run along side walls of the chamber;

automatic doors for selectively sealing the access opening during a washing cycle, the tracks guiding the washer doors as they are retracted into the chamber to open the access opening between washing cycles, the doors including a plurality of panels;

hinges which allow the doors to pivot around a vertical axis between the panels to facilitate movement of the doors along the curving tracks;

a tilting floor assembly; and a tilt control circuit which recognizes the end of a cleaning cycle and levels the tilting floor assembly before the doors are retracted.

18. The washer of claim 17, wherein the tilting floor assembly includes:

a frame support;

a frame supported by the frame support;

a floor supported by the frame; and a lifting mechanism for selectively raising and lowering a side of the frame, the lifting mechanism including:

rotating cams which lift the side of frame a selected distance when rotated, and a tilt drive mechanism which rotates the cams to raise and lower the frame side the selected distance to tilt the floor.

19. The washer of claim 18, wherein the lifting mechanism further includes:

levers, the levers connected to each of the cams, and a bar which connects the levers, the tilt drive mechanism connected to one of the levers.

20. The washer of claim 18 further including:

a tilt control circuit, for actuating the tilt drive mechanism, the tilt control circuit recognizing the end of a cleaning cycle and signaling the tilt drive mechanism to lower the floor.

21. The washer of claim 20, wherein the washing chamber includes automatic doors which retract into the washing chamber to open and the tilt control circuit lowers the floor before the doors are opened.

22. The washer of claim 21, wherein the floor includes:

floor panels which slot into the frame, the panels having ridges which run perpendicular to an access opening in the washing chamber.

23. The washer of claim 18, wherein the tilt drive mechanism includes a pneumatic cylinder.

24. A washer for cleaning inanimate items comprising:

a washing chamber;

an opening for providing access to the washing chamber;

retractable doors which selectively seal the opening and open to allow a load of the inanimate items to be processed to be transported into the washing chamber, the doors including:

a plurality of blowout panels, and a blowout mechanism which releasably couples at least one of the panels to the retractable doors such that when pushed outward from an interior of the washing chamber, the panel opens out, allowing an operator inadvertently trapped within the washing chamber to escape from the chamber interior;

a warning system for indicating that a cleaning cycle is about to commence, the warning system including a light which is visible from within the chamber and a warning light control circuit, the control circuit switching the light for a short period before the cleaning cycle commences to give the operator sufficient time to exit the washing chamber; and a switch which is engaged when one of the blow out panels opens for stopping a washing cycle in progress.

* * * * *